US009908245B1

(12) United States Patent
Tkachenko

(10) Patent No.: US 9,908,245 B1
(45) Date of Patent: Mar. 6, 2018

(54) LOCKING MECHANISM FOR A FOLDING INSTRUMENT

(71) Applicant: SPORT MANUFACTURING GROUP INC., Forest Hills, NY (US)

(72) Inventor: Anton Tkachenko, St. Petersburg (RU)

(73) Assignee: Sport Manufacturing Group Inc., Forest Hills, NY (US)

( * ) Notice: Subject to any disclaimer, the term of this patent is extended or adjusted under 35 U.S.C. 154(b) by 0 days.

(21) Appl. No.: 15/342,753

(22) Filed: Nov. 3, 2016

(51) Int. Cl.
*B26B 1/04* (2006.01)

(52) U.S. Cl.
CPC ..... *B26B 1/048* (2013.01); *B26B 1/044* (2013.01)

(58) Field of Classification Search
CPC ..... B26B 1/044; B26B 1/048
See application file for complete search history.

(56) References Cited

U.S. PATENT DOCUMENTS 6,553,672 B2 4/2003 Glesser et al.
6,941,661 B2 9/2005 Frazer
7,059,053 B2 6/2006 Sakai
7,222,429 B2 5/2007 PerMar, Jr.
7,293,360 B2 * 11/2007 Steigerwalt ..... B26B 1/02 30/159
7,469,476 B2 12/2008 Demko
7,698,821 B2 * 4/2010 Ralph ..... B26B 1/048 30/158
7,748,122 B2 * 7/2010 Duey ..... B26B 1/048 30/159
7,941,927 B1 5/2011 Demko
8,296,958 B1 10/2012 Frazer
RE43,908 E 1/2013 Demko
8,893,389 B2 * 11/2014 Freeman ..... B26B 1/046 30/155
9,527,218 B2 * 12/2016 Valdez ..... B26B 1/02
9,808,940 B1 * 11/2017 Sakai ..... B26B 1/042
9,815,213 B2 * 11/2017 Duey ..... B26B 1/046
2004/0045170 A1 3/2004 Glesser
2004/0261272 A1 * 12/2004 Moser ..... B26B 1/04 30/160
2008/0201953 A1 * 8/2008 Bremer ..... B26B 1/046 30/1
2015/0266188 A1 9/2015 Demko
2015/0352731 A1 12/2015 France

OTHER PUBLICATIONS

PCT International Search Report.

* cited by examiner

*Primary Examiner* — Hwei C Payer
(74) *Attorney, Agent, or Firm* — Anna Vishev, Esq.

(57) ABSTRACT

A folding knife, including a handle, with at least two parts connected to form a cavity therebetween, and a blade having a sharpened edge and a tang. The blade is rotatable between an open position and a closed position. The blade defines a first plane inside the cavity. The tang includes a step protrusion and a rounded protrusion. A stop pin restricts movement of the blade in an opening direction. The folding knife also includes a locking member rotatable from a first position, allowing the blade to rotate, to a second position blocking rotation of the blade by engaging one of the tang's protrusions. The engagement of the locking member with the step protrusion of the tang locks the blade in its open position, and the engagement of the locking member with the rounded protrusion of the tang locks the blade in its closed position.

12 Claims, 5 Drawing Sheets

LOCKING MECHANISM FOR A FOLDING INSTRUMENT

BACKGROUND OF THE INVENTION

This invention relates generally to folding knives, and, more broadly, to the folding instruments, the working part of which can be locked in an open position.

Folding knives and folding instruments used for various purposes are known from the prior art. Many such tools and knives include a blade locking mechanism, securing the blades in the working, i.e., the open, position. An example of such mechanism is shown in U.S. Pat. No. 6,941,661.

Some (but not all) of the known lock mechanism designs are symmetrical about a plane parallel to the sides of the tang of the blade, lying equidistantly between the sides. Examples of such designs include "lock back," "mid lock," "axis lock," "arc lock" etc. This symmetry allows for an equally convenient use of the folding knife or instrument for both right- and left-handed users. Such convenience can be considered an advantage as compared with asymmetrical designs of locking mechanisms (liner lock, frame/integral lock, button lock, compression lock, etc.) which limit usability for left-handed users (or for right-handed users if the lock is specifically designed for left-handed users). Another advantage of a symmetrical design is the ease of design and manufacturing of the resulting folding knife or instrument because, in the case of symmetry, many parts can be standardized unlike for knives and tools having locks with an asymmetrical structure.

Some of the famous locks of symmetrical designs allow its user to unlock and fold the blade or tool from the open (i.e., operating) position using the same hand in which the user holds the knife/tool. Thus, such locks (referred to as one-armed symmetrical locks) have the advantage of ease of use compared to the locks which require the use of two hands (lock back, for example).

Some of these locks include fairly compact designs which allow a manufacturer to make a folding knife or a tool of smaller dimensions, which, in turn, can also be considered a competitive advantage.

In addition, benefits of the above-described designs include safety of use, ease of manufacturing technology, and an ability to make a lighter folding knife or tool.

Keeping in mind strength and reliability of construction, following is the list of important parameters advantageous for construction of a locking mechanism for a folding knife/instrument from the point of view of convenience of use:

- Symmetry with respect to the plane of the blade or tool
- The ability to use the folding knife with one hand without the aid of the second hand
- Adaptability to design and production, the possibility of unification of parts
- Compactness
- Use safety, specifically, the ability to unlock the lock without the need of placing fingers in a blade rotation area (as it has to be done in liner locks or lock back locks, for example).
- The ability to reduce the weight of a folding knife/instrument.

The invention described and claimed herein is superior to the described prior art locks. First, in contrast to the prior art locks, presently described and claimed locking mechanism does not need to include handle-held lining plates of solid steel or titanium alloys. For example, in axis locks the load on the folding blade or tool is transferred from the blade/tool tang through the locking pin onto the metal liners. In arc locks, this load is transferred by a swing arm but also onto the metal liners. In ball bearing locks, a metal ball passes the load onto an additional element secured between the metal liners. Compared to all of these prior art design, in the presently disclosed and claimed locking mechanism, the load of folding the blade/tool is transferred by the tang onto a stop pin through an element rotating about the same pin. Thus, the entire load directed to the blade/tool in the unfolding or folding direction, is assumed by the stop pin secured at the front of the handle, that restricts the movement of the folding blade and, at the same time, functions as a rotational axis for the main locking element.

A similar load transfer scheme in the stopper (resistant) pin is described in the patent Tri-Ad Lock by Andrew Demko. However, the entire locking mechanism of the above-mentioned patent is quite different the presently disclosed locking mechanism. Tri-Ad lock design is nearly identical to a previously known lock back mechanism, or its later modification, known as the Mid lock. Tri-Ad Lock design is not compact and takes up a lot of space in the blade folding plane, that makes folding knives with Tri-Ad Lock relatively non-compact themselves when folded. Further, it is very uncomfortable to fold a knife with a Tri-Ad lock with one hand and, during such process of folding, it is practically necessary to place some fingers of the same hand into the blade turning plane, thereby increasing the danger of injury.

The design of the present invention does not require metal plate liners. Stop pin can be installed directly into the base of the handle, which may be made of durable and light-weight material (e.g. aluminum alloys, textolite, cast plastics, etc.). Elimination of metal plate liners, as well as, the size reduction of the lock elements enables the manufacturers to make the folding knife lighter and more compact than in the case of other known symmetric lock designs.

Finally, the presently described and claimed locking mechanism is arranged in such a way that sliding elements, protruding from the handle and secured on the main locking element, allow a user to hold the open knife/tool with one hand and to use the fingers of the same hand to move the locking mechanism (releasing the blade from its locked position) by pressing on one of sliders and to fold the blade/tool. The direction in which the user needs to act on the slider protruding from the handle is very natural and does not force the user to make awkward manipulations with an open knife in his/her hand. In no time, during the above blade releasing and closing process, do user's fingers need to be placed in the dangerous zone of blade rotation making manipulations of the folding knife safer.

SUMMARY OF THE INVENTION

It is an object of the present invention to provide a locking mechanism for a folding knife or a folding instrument.

In one of its general aspects, the invention is a folding knife, including a handle and a blade. The handle has at least two parts connected to each other to form a cavity therebetween. The blade has at least one sharpened edge and a tang with an axial hole. The blade is rotatable around the axial hole between an open position, in which the sharpened edge extends outside the cavity and the tang is located inside the cavity, and a closed position, in which the sharpened edge and the tang are both located inside the cavity. The blade defines a first plane inside the cavity, and the tang further includes a step protrusion, a rounded protrusion and a radial perimeter extending between these two protrusions. An axial pin is inserted into the axial hole of the tang to rotatably secure the blade to a first end of the handle. A stop pin is attached to at least one of the two parts of the handle at the same first end of the handle within the cavity. The stop pin restricts movement of the blade in an opening direction. The folding knife also includes a locking member rotatably fitted onto the stop pin and located inside the cavity in the same first plane defined by the blade. The locking member is rotatable from a first position allowing the blade to rotate around the axial hole to a second position blocking rotation of the blade by engaging one of the tang's protrusions. The engagement of the locking member with the step protrusion of the tang locks the blade in its open position, and the engagement of the locking member with the rounded protrusion of the tang locks the blade in its closed position.

In one of its more specific aspects, the folding knife also includes at least one spring secured inside the cavity of the handle. The spring exerts a resilient force onto the locking member in a direction of rotation of the locking member into a position locking the blade in its open position.

In another more specific aspect, the folding knife also includes at least one slider connected to the locking member and protruding outside the handle. The slider follows movements of the locking member as the locking member rotates around the stop pin, and allows a user to rotate the locking member, thereby unlocking the blade, by pressing against the slider.

The above aspects, advantages and features are of representative embodiments only. It should be understood that they are not to be considered limitations on the invention as defined by the claims. Additional features and advantages of the invention will become apparent in the following description, from the drawings, and from the claims.

BRIEF DESCRIPTION OF THE DRAWINGS

The invention is illustrated by way of examples which are not a limitation, and the figures of the accompanying drawings in which references denote corresponding parts, and in which.

DETAILED DESCRIPTION

Figure 1:
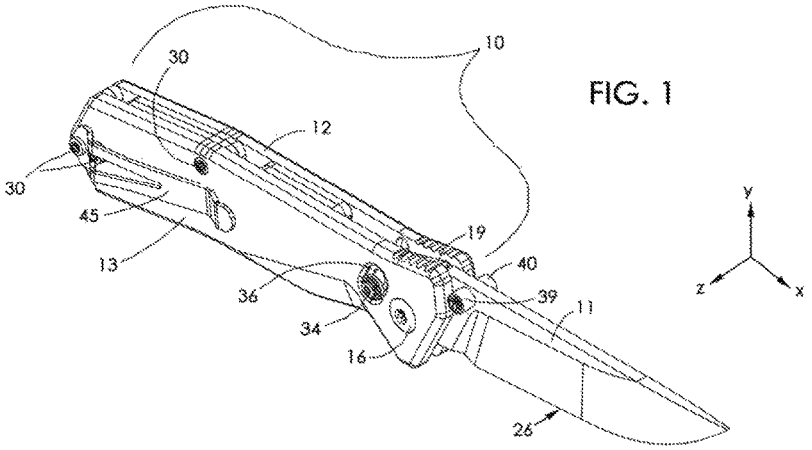
FIG. 1 shows a perspective view of a folding knife having a lock mechanism in accordance with a preferred embodiment of the present invention. The blade of the knife is in the open position.

As shown in FIG. 1, in accordance with the preferred embodiment of the present invention, a folding knife is provided having a novel locking mechanism. In FIG. 1, knife blade 11 extends from the handle 10 and is shown in its opened (i.e., working) position. Tang 25 of the blade 11 is positioned within a cavity formed between the two halves 12 and 13 of the handle 10. Thumb studs 39 and 40 are secured on the blade 11 to facilitate opening of the blade from the closed position using a thumb of the hand holding the knife. Thumb studs 39 and 40 are not essential to the invention and may be present or absent in the described structure. As further shown in FIG. 1, the knife includes a pocket clip 45 preferably secured with screws 30 to the handle halve 13 of the handle 10. This clip is also not essential to the invention and may be present in the structure or absent therefrom.

Figure 2:
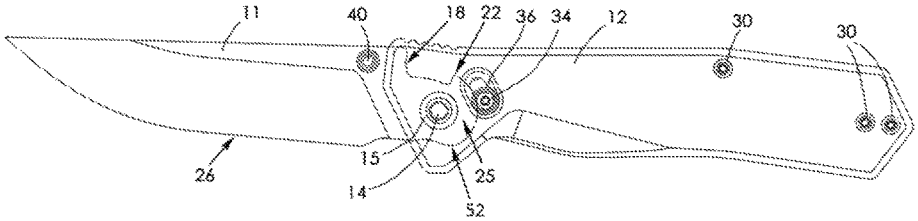
FIG. 2 shows a side view of the knife shown in FIG. 1 with the blade of the knife being in an open position. Contours of the blade hidden inside the handle are shown by the dotted line.

FIG. 2 shows a side view of the knife shown in FIG. 1. Contours of the blade 11 hidden inside the handle are shown by the dotted line. FIG. 2 further shows how tang 25 is positioned within the cavity formed by the halves 12 and 13 of the knife handle 10.

Figure 3:
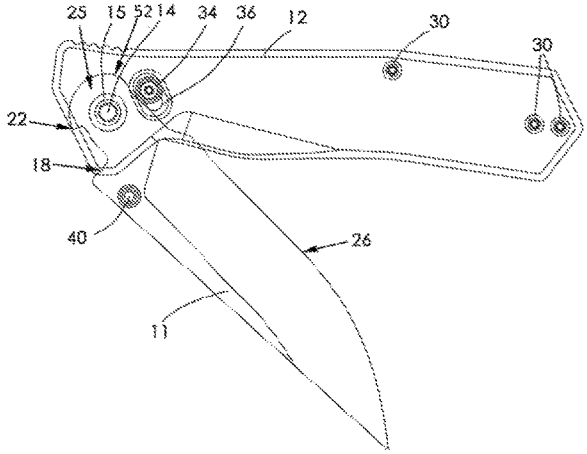
FIG. 3 shows the side view of the knife shown in FIG. 1 with the blade of the knife being in a semi-open/semi-folded position. Contours of the blade hidden inside the handle are shown by the dotted line.

FIG. 3 shows the same knife as shown in FIG. 2 from the side with the knife blade 11 being in a semi-open/semi-closed position. Contours of the blade 11 hidden inside the handle are also shown by the dotted line. FIG. 3 shows how tang 25 of the blade 11 rotates with respect to its position in FIG. 2.

Figure 4:
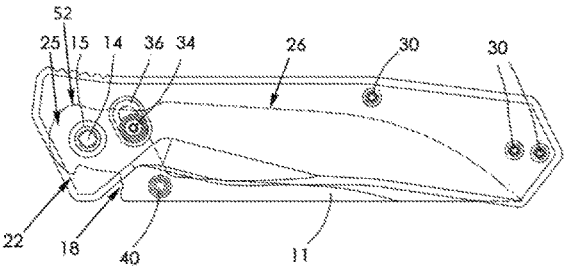
FIG. 4 shows the side view of the knife shown in FIG. 1 with the blade of the knife being in a folded/closed position. Contours of the blade hidden inside the handle are shown by the dotted line.

FIG. 4 shows the same knife as shown in FIG. 2 from the side with the knife blade 11 being in the closed (folded) position. Contours of the blade 11 hidden inside the handle are again shown by the dotted line. FIG. 3 shows how tang 25 of the blade 11 is further rotated with respect to its position in FIG. 2 and FIG. 3.

Figure 5:
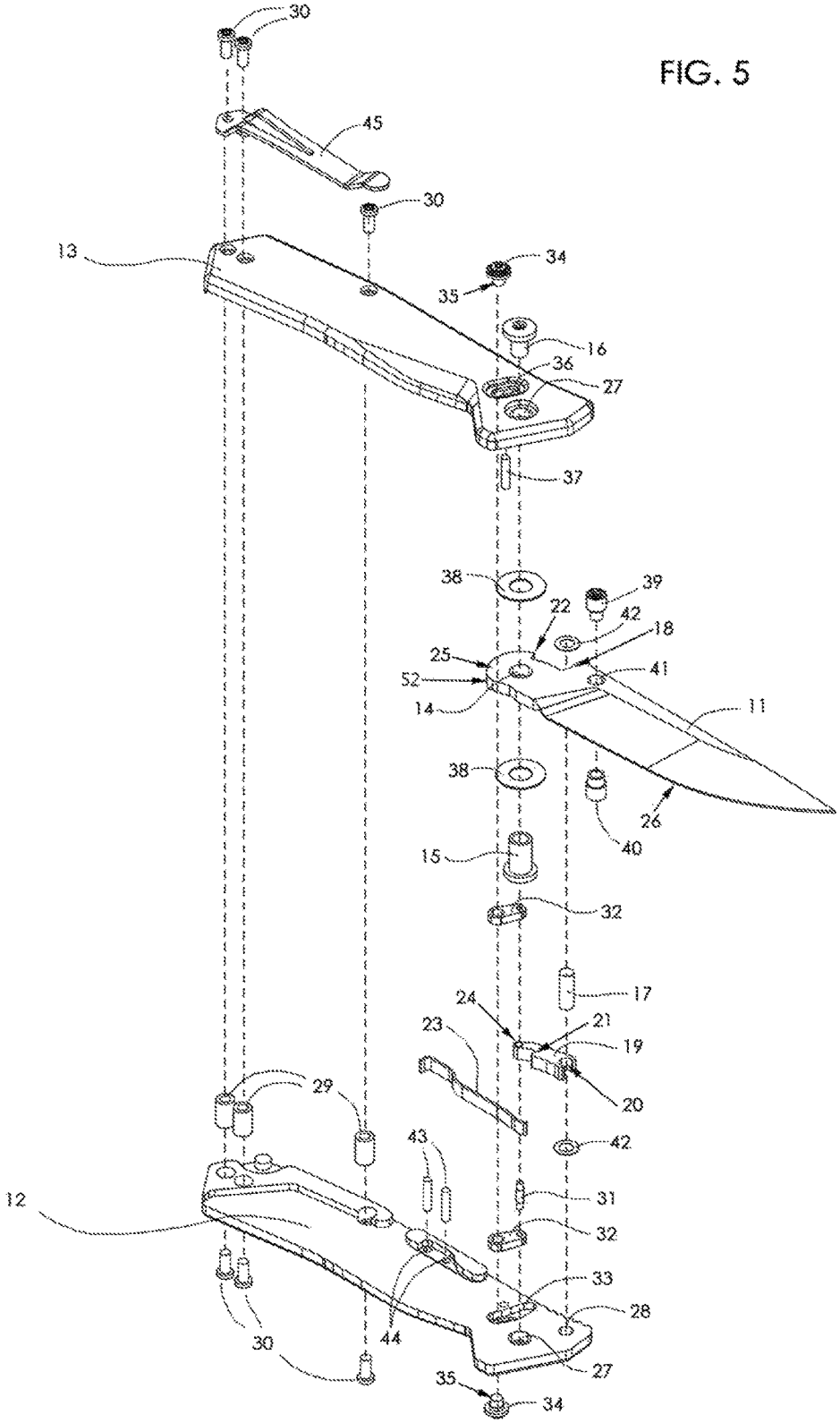
FIG. 5 shows a spatially exploded diagram of the blade shown in FIG. 1.

FIG. 5 shows a three-dimensional exploded diagram of the knife shown in FIG. 1. The top portion of FIG. 5 shows the outer part of the halve 13 of the handle 10, as well as other elements of the folding knife that are visible from the outside when folding knife is assembled. Specifically, these elements include an axial screw 16 securing an axial pin 15 to enable the blade's rotation, a part of an axial hole 27 formed in the halves 12 and 13 of the handle 10, a groove 36 and a slider element 34 which moves along groove 36. FIG. 5 also shows various elements which are not essential to the present invention and which can be absent from the structure. These elements include pin 37 restricting movement of the blade in the closing (i.e. folding) direction, screws 30 connecting the two halves 12 and 13 of the handle 10, and the pocket clip 45.

The lower part of FIG. 5 shows an inner part of the handle half 12 as well as multiple element positioned inside the cavity formed by handle halves 12 and 13, these elements being not visible or partially visible when the described folding knife is assembled. As shown in FIG. 5, a stop (locking or abutment) pin 17 is mounted in at least one socket 28 located in the front portion of the handle. A locking member 19 includes a front part 20 with a curved recess which is rotatably fitted onto the stop pin 17, a rear part 24 located at the side of the locking member opposite from the front part 20 connected to the stop pin 17, and a protrusion 21 located between the rear part 24 and the front part 20. When the knife is assembled, locking member 19 moves along the same plane as the blade 11. A spring 23 is further provided with one of its ends being affixed to the handle, for example, with pins 43 inserted in nests 44. Spring 23 is preferably formed as a resilient plate or a resilient wire rod. When spring 23 is secured to the handle 10 with one of its ends, the other end of the spring 23 acts on the rear part 24 of the locking member 19. Further, links 32 are located in slots 33 formed within halves 12 and 13 of the handle 10 and are rotatably connected to the locking member 19 by a pin 31 passing through a hole in the rear part 24 of the locking element 19. Sliders 34 are positioned in grooves 36 and secured to links 32 via a connecting pin 35.

Bushings 29, which are not essential to the described invention, preferably have an internal threading and serve to secure together halves 12 and 13 of the handle 10 by means of screws 30.

As shown in the central part of FIG. 5, the knife includes blade 11 with tang 25 having an axial hole 14 and at least two protrusions, i.e., a step protrusion 22 and a rounded eccentric protrusion 52. The perimeter of the tang between these two protrusions is hereafter referred to as the radial perimeter. Blade 11 has at least one sharpened (i.e., honed) edge 26 and stop edge 18, which rests against the stop pin 17 when the blade 11 is in its fully extended (i.e., open) position. Washers 38 are placed onto the axial pin 15 on either side of the blade and are used for the smooth running of the blade. Small washers 42 are placed onto the stop pin 17 on either side of the locking member 19 and serve to smoothly move the locking member. Thumb studs 39 and 40 are attached to the blade via opening 41 to facilitate movement of the blade of the described folding knife from the closed position into the open position. It should be mentioned that the elements 38, 42, 41, 39 and 40 are not essential to the construction of the disclosed invention.

As can be seen from FIG. 5, stop pin 17 secured at the front of the handle restricts the movement of the folding blade in the unfolding direction and, at the same time, functions as a rotational axis for the locking member 19.

Figure 6:
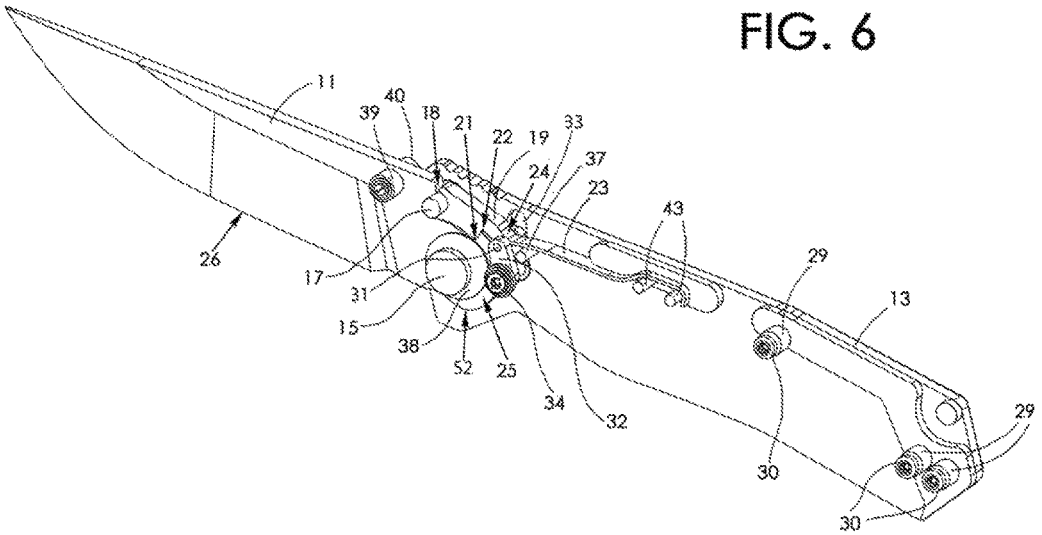
FIG. 6 shows a perspective view of a folding knife having a lock mechanism in accordance with the preferred embodiment of the present invention. The blade of the knife is in the open position. The left half of the handle is not shown so as to expose the elements of the invented lock mechanism.

FIG. 6 shows a perspective view of the described folding knife with the left half of the handle being removed so as to show elements of the locking mechanism. FIG. 6 shows the same elements shown in FIG. 5 and described in the paragraphs above but in their assembled positions within the folding knife. Blade 11 is shown in its open (working) position, in which stop edge 18 abuts stop pin 17, to which, in turn, is pivotally connected the locking member 19. As can be seen in FIG. 6, in this position of the blade, protrusion 21 of the locking member 19 abuts and extends beyond step protrusion 22 of tang 25 of blade 11, thus preventing the movement of the blade in the direction of folding. In other words, locking element 19 is in a position locking blade 11 in the open (working) state. As described above, one end of spring 23 is secured inside the handle, while the other end exerts pressure on the rear part 24 of the locking member 19, thereby holding the locking element 19 in its blade locking position. Links 32 are movably connected to the locking member 19 on both sides via a pin 31 inserted into an axial hole formed in the rear part 24. Further, sliders 34 are attached to each link 32 such that each slider 34 moves within groove 36 (shown in FIG. 5) following the movements of the locking member.

Figure 7:
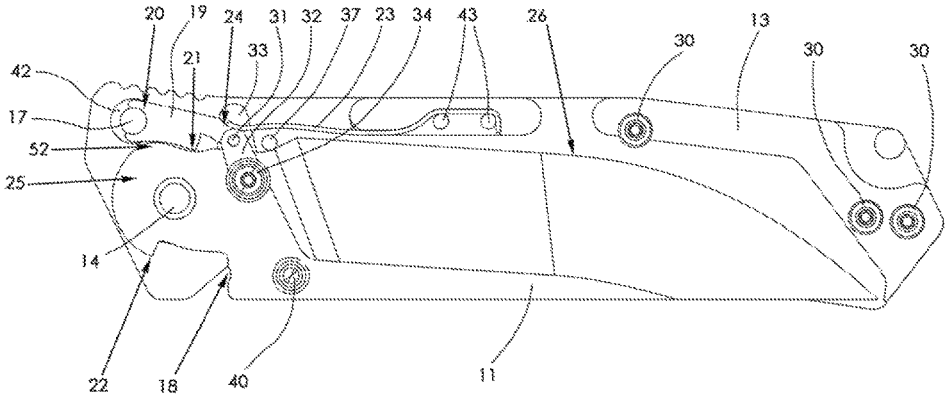
FIG. 7 shows the same side view of the knife as shown in FIG. 2 with the left half of the handle being removed so as to expose the elements of the lock mechanism.
Figure 8:
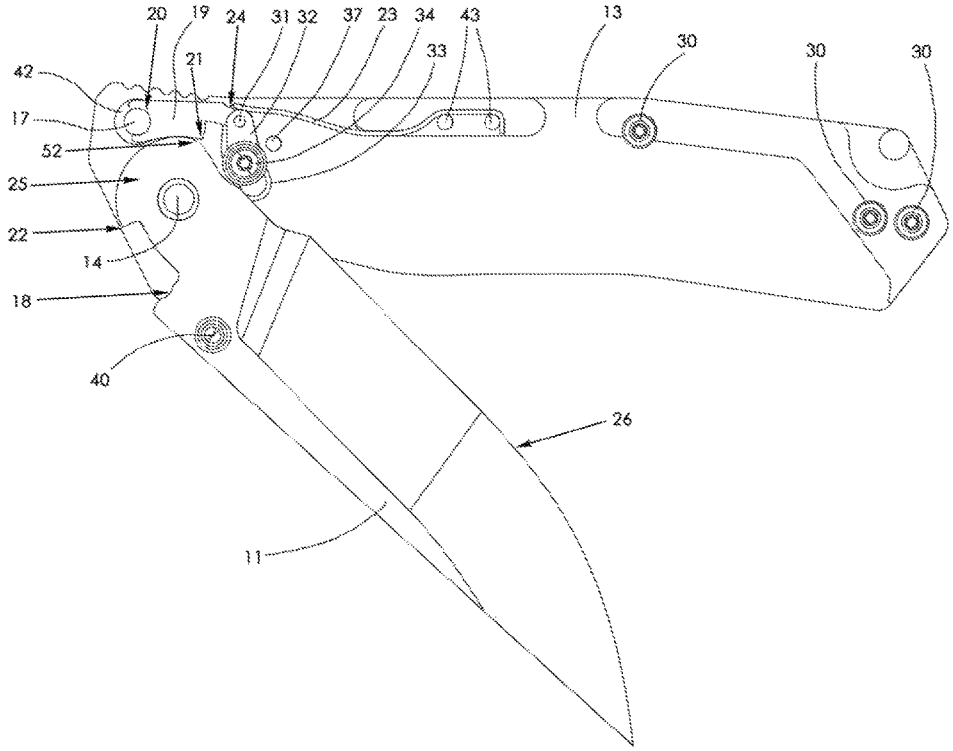
FIG. 8 shows the same side view of the knife as shown in FIG. 3 with the left half of the handle being removed so as to expose the elements of the lock mechanism.
Figure 9:
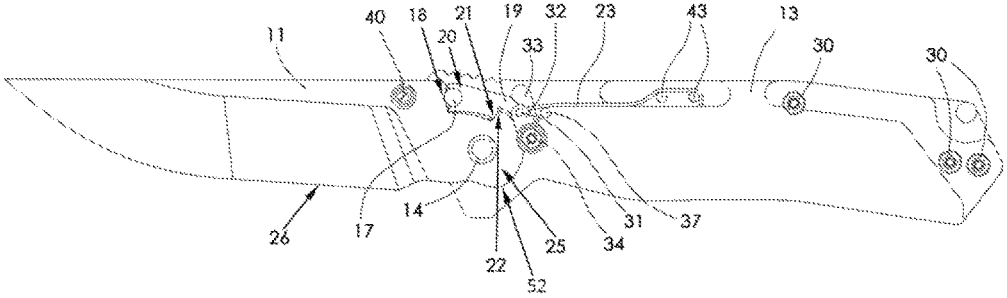
FIG. 9 shows the same side view of the knife as shown in FIG. 4 with the left half of the handle being removed so as to expose the elements of the lock mechanism.

FIG. 7-9 show a side view of the folding knife in its various operating states. The left half of the handle is not shown in these figures to allow a viewer to see all the main operational components of the invented locking mechanism and to track movements and interconnection of these components.

To start, FIG. 7 shows blade 11 in its folded (i.e., closed) position, in which the blade abuts against pin 37 restricting further movement of the blade in the folding direction. Locking member 19 under the influence of spring 23 presses on the rounded protrusion 52 of the tang 25 thus holding blade 11 in the folded (i.e., closed) position. This position of the locking member 19 will be referred to hereinafter as the lowest position. Sliders 34, connected by means of pins 31 and links 32 to the locking member 19, are also in their lower position. This position of sliders 34 within grooves 36 (as viewed from outside of the handle) is further illustrated in FIG. 4.

Next, FIG. 8 shows blade 11 in its semi-open position. Tang 25, and with it step protrusion 22 and a rounded protrusion 52, is rotated around axis 15 resulting in protrusion 52 overcoming the force of spring 23 and pushing locking member 19 into a position hereinafter referred to as the top position. Correspondingly, because sliders 34 are connected to the locking member 19 via pin 31 and links 32 moving within slots 33, position of sliders 34 has also changed with the position of locking member 19. This position of sliders 34 will be hereinafter referred to as their top position. This position of sliders 34 within grooves 36 (as viewed from outside of the handle) is further illustrated in FIG. 3

Finally, FIG. 9 shows blade 11 in the open position. Comparing positions of various components in FIG. 8 and FIG. 9, it can be seen that rounded protrusion 52 and step protrusion 22 turned with the blade and tang 25. When the blade 11 is fully extended and stop edge 18 of the blade 11 abuts the stop pin 17, locking member 19 under the influence of spring 23 is rotated around the stop pin 17 into its lower position, where projection 21 of the locking member 19 extends beyond step protrusion 22 of tang 25 once again securely locking blade 11 in the open (i.e., working or expanded) position. Since locking member 19 is again located in the lower position, sliders 34 are also in their lower positions. This position of sliders 34 within grooves 36 (as viewed from outside of the handle) is further illustrated in FIG. 2.

The process by which the user unlocks and folds the blade of the described folding knife is described with reference to FIGS. 2-4 and 7-9. In the open and locked position, shown in FIGS. 2 and 9, sliders 34 are in their lower position. As explained above, sliders 34 are accessible from the outside of the knife handle and are movable from their lower position to their top position within grooves 36. To release the blade, the user moves one of sliders 34 from its lower position to its top position thereby breaking the force of spring 23 and releasing protrusions 21 and 22 from their locked position. Then, either by pushing on the unsharpened edge of the blade or by inertia, the user rotates the blade through the semi-open position (shown In FIGS. 3 and 8) into the closed position (shown in FIGS. 4 and 7), thereby allowing the front part 20 of the locking member to slide along the radial perimeter of the tang 25, and releases slider 34, thereby allowing locking member 19 under the force of spring 23 to press against the rounded protrusion 52 to lock the blade in the closed position. Conversely, to move the blade from the closed/locked position, the user moves one of the sliders 34 from its lower position to its top position thereby breaking the force of spring 23 and releasing the rounded protrusion 52 from its engagement with the locking member. Then, either by pushing on one of the thumb studs 39, 40 or by inertia, the user rotates the blade through the semi-open position into the open position and releases slider 34, thereby allowing protrusion 21 of the locking member under the force of spring 23 to engage step protrusion 22 of the tang 25, so as to lock the blade in its open position. It should be noted that the direction of movement of sliders 34 and the location of groove 36, are selected in a way allowing the user to comfortably accomplish the above movement of the sliders with one hand. In other words, while the knife is held in one hand, a thumb of the same hand can be used to move one of the sliders 34 into the top position breaking the force of spring 23.

In the preceding specification, the invention has been described with reference to specific exemplary embodiments thereof. It will however, be evident that various modifications and changes may be made thereto without departing from the broader spirit and scope of the invention as set forth in the claims that follow. The specification and drawings are accordingly to be regarded in an illustrative manner rather than a restrictive sense.

I claim as follows:

1. A folding knife, comprising:

a handle having at least two parts connected to each other to form a cavity therebetween;

a blade having at least one sharpened edge and a tang with an axial hole, said blade being rotatable around said axial hole between an open position, in which said sharpened edge of said blade extends outside said cavity and said tang is located inside said cavity, and a closed position, in which said sharpened edge of said blade and said tang are both located inside said cavity, said blade defining a first plane inside said cavity, said tang further including a step protrusion, a rounded protrusion and a radial perimeter extending between said step protrusion and said rounded protrusion;

an axial pin inserted into said axial hole of said tang and rotatably securing said blade to a first end of said handle;

a stop pin attached to at least one of said two parts of said handle at the first end of said handle within said cavity, said stop pin being configured to restrict movement of said blade in an opening direction; and a locking member having a front part, a rear part with an aperture and a step protrusion formed therebetween, the front part of the locking member further comprising a curved recess rotatably fitted onto said stop pin such that said curved recess only partially surrounds said stop pin without preventing a contact between said blade and said stop pin, said locking member being located inside said cavity in the same first plane defined by said blade and above an axis of the folding knife, said locking member being rotatable from a first position allowing said blade to rotate around said axial hole to a second position blocking rotation of said blade by engaging one of said protrusions of said tang, wherein engagement of said locking member with said step protrusion of said tang locks said blade in said open position and wherein engagement of said locking member with said rounded protrusion of said tang locks said blade in said closed position.

2. The folding knife according to claim 1, further comprising at least one spring secured inside said cavity of said handle and exerting a resilient force onto the rear part of the locking member in a direction of rotation of said locking member into a position locking said blade in said open position.

3. The folding knife according to claim 2, wherein said spring comprises a resilient plate.

4. The folding knife according to claim 2, wherein said spring comprises a resilient wire rod.

5. The folding knife according to claim 1, further comprising at least one link rotatably connected to said aperture of the rear part of said locking member, said link being positioned within a slot formed within said handle, said slot being distanced from a plane in which said blade rotates, said link being configured to follow movements of said locking member as said locking member rotates around said stop pin.

6. The folding knife according to claim 5, further comprising at least one slider connected to said link and protruding outside said handle through said slot, said slider being configured to follow movements of said link and said locking member as said locking member rotates around said stop pin, said slider being further configured to allow a user to rotate said locking member thereby unlocking said blade by pressing against said slider.

7. A folding instrument, comprising:

a handle having at least two parts connected to each other to form a cavity therebetween;

a tool having a working part and a tang with an axial hole, said tool being rotatable around said axial hole between an open position, in which said working part of said tool extends outside said cavity and said tang is located inside said cavity, and a closed position, in which said working part of said tool and said tang are both located inside said cavity, said tool defining a first plane inside said cavity, said tang further including a step protrusion, a rounded protrusion and a radial perimeter extending between said step protrusion and said rounded protrusion;

an axial pin inserted into said axial hole of said tang and rotatably securing said tool to a first end of said handle;

a stop pin attached to at least one of said two parts of said handle at the first end of said handle within said cavity, said stop pin being configured to restrict movement of said tool in an opening direction; and a locking member having a front part, a rear part with an aperture and a step protrusion formed therebetween, the front part of the locking member further comprising a curved recess rotatably fitted onto said stop pin such that said curved recess only partially surrounds said stop pin without preventing a contact between said blade and said stop pin, and said locking member being located inside said cavity in the same first plane defined by said tool and above an axis of the folding instrument, said locking member being rotatable from a first position allowing said tool to rotate around said axial hole to a second position blocking rotation of said tool by engaging one of said protrusions of said tang, wherein engagement of said locking member with said step protrusion of said tang locks said tool in said open position and wherein engagement of said locking member with said rounded protrusion of said tang locks said tool in said closed position.

8. The folding instrument according to claim 7, further comprising at least one spring secured inside said cavity of said handle and exerting a resilient force onto the rear part of the locking member in a direction of rotation of said locking member into a position locking said tool in said open position.

9. The folding instrument according to claim 8, wherein said spring comprises a resilient plate.

10. The folding instrument according to claim 8, wherein said spring comprises a resilient wire rod.

11. The folding instrument according to claim 7, further comprising at least one link rotatably connected to said aperture of the rear part of said locking member, said link being positioned within a slot formed within said handle, said slot being distanced from a plane in which said tool rotates, said link being configured to follow movements of said locking member as said locking member rotates around said stop pin.

12. The folding instrument according to claim 11, further comprising at least one slider connected to said link and protruding outside said handle through said slot, said slider being configured to follow movements of said link and said locking member as said locking member rotates around said stop pin, said slider being further configured to allow a user to rotate said locking member thereby unlocking said tool by pressing against said slider.

* * * * *